United States Patent [19]

Jackson

[11] 4,211,914

[45] Jul. 8, 1980

[54] ELECTRIC HAIR CURLING DEVICE HAVING A ROTATABLE CURLING BARREL

[76] Inventor: Larry D. Jackson, 1419 E. 111th St., Cleveland, Ohio 44106

[21] Appl. No.: 820,303

[22] Filed: Jul. 29, 1977

[51] Int. Cl.[2] ..... A45D 1/04; A45D 2/36; H05B 1/00

[52] U.S. Cl. ..... 219/225; 132/32 R; 132/34 R; 132/37 R; 219/533

[58] Field of Search ..... 219/222–226, 219/230, 533; 132/31 R, 31 A, 32 R, 32 A, 34 R, 34 A, 34 B, 34 C, 9, 11, 37 R, 37 A

[56] References Cited

U.S. PATENT DOCUMENTS

| | | | |
|---|---|---|---|
| 1,820,498 | 8/1931 | Rowley | 132/34 R |
| 1,857,689 | 5/1932 | Melkman | 132/34 R |
| 1,894,751 | 1/1933 | Baum | 219/225 X |
| 1,929,012 | 10/1933 | Boda | 132/31 R |
| 2,448,263 | 8/1948 | Hannon | 132/34 R |
| 2,524,058 | 10/1950 | Kamara | 132/34 R |
| 3,533,421 | 10/1970 | Mays | 219/226 X |
| 3,610,259 | 10/1971 | Brown | 219/222 UX |
| 3,731,694 | 5/1973 | Moro | 219/222 UX |
| 3,805,811 | 4/1974 | Dorm | 219/222 UX |

*Primary Examiner*—A. Bartis

*Attorney, Agent, or Firm*—Baldwin, Egan, Walling & Fetzer

[57] ABSTRACT

A hair curling device includes a handle having a front end provided with a socket in which an enlarged cylindrical rear end of an electrically heated hair curling barrel is rotatably mounted. An annular cap-like coupling member secured to the handle couples the barrel rear end in the socket. The barrel is rotated by an electric motor in the handle coupled to the enlarged barrel end by a drive shaft which also carries electrical connection means permitting electric power to be supplied to the heating element in the barrel while the barrel rotates. A pivoted hair clip extends along and parallel to a major portion of the heated barrel and the other end of the barrel is provided with a heat insulating tip member including a radially extending annular portion. Electric power is supplied to the motor and heating element through a power cord connected to the other end of the handle by a swivel connector. Separate switches for controlling the motor and heating element are provided.

1 Claim, 5 Drawing Figures

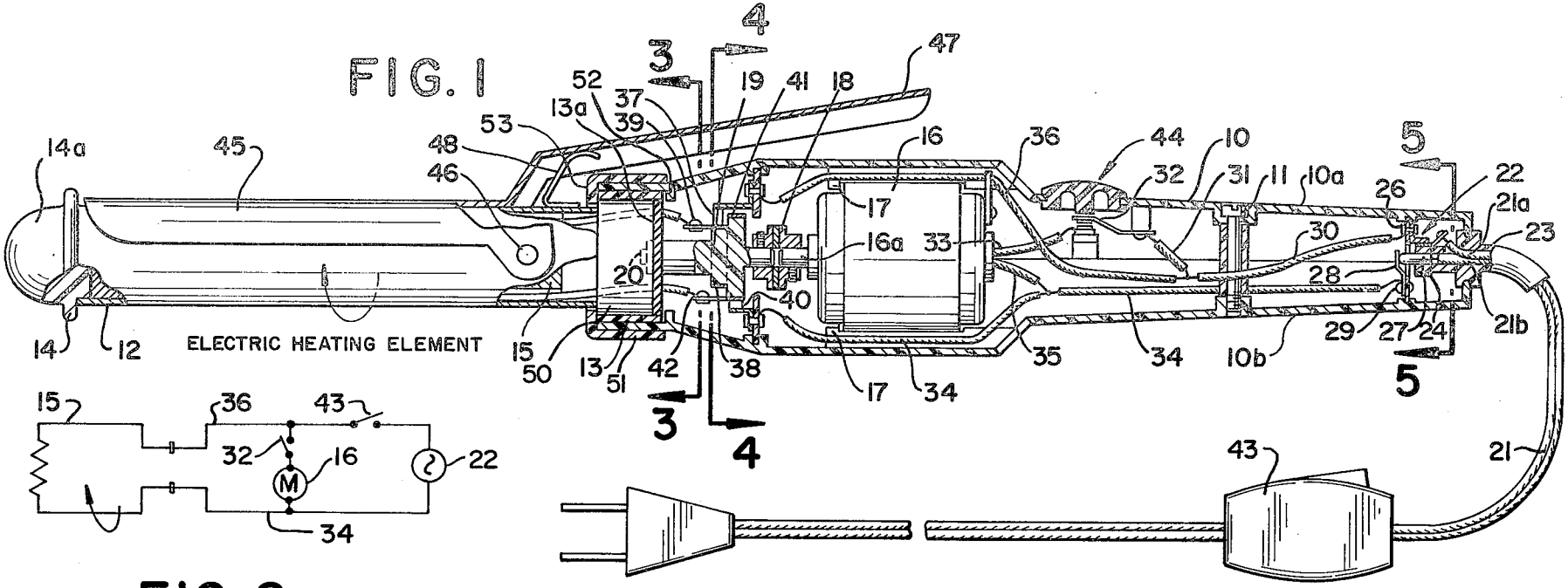
FIG. 1
FIG. 2
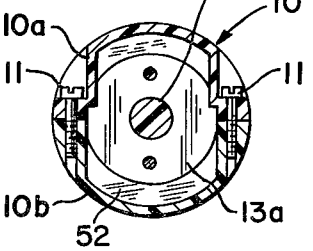
FIG. 3
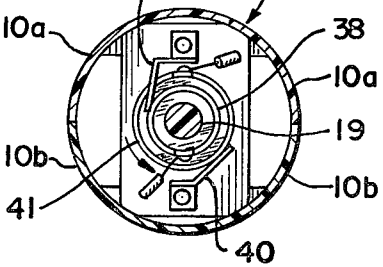
FIG. 4
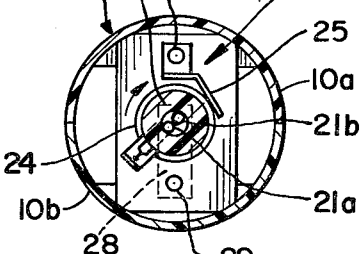
FIG. 5

ELECTRIC HAIR CURLING DEVICE HAVING A ROTATABLE CURLING BARREL

BACKGROUND OF THE INVENTION

Curling irons are used today, which supply a manually rotated barrel which is electrically heated along its entire length, and utilizes a hair clip extending along the entire heated barrel, which is oscillated back and forth by the hand of the operator. One of the objections to the said presently used curling irons or devices is that the operator occasionally, unintentionally, touches the scalp of the patient with the heated barrel of the curling iron, which causes great discomfort. One of the objects of the present invention is to avoid such discomfort to the person whose hair is being curled.

DESCRIPTION OF THE INVENTION

A curling device is presented comprising, a handle, a hollow hair curling barrel having an end rotatably mounted in one end of the handle and extending forwardly therefrom to a tip end, there being an electric heating element in the hollow of the barrel and electrically insulated therein. The tip end of the barrel is a smooth extension thereof and has a heat insulating radially extending annulus closely adjacent to the tip end, the tip end and annulus being heat insulated from the remaining heated portion of the curling barrel. A fractional horsepower electric motor is fixed in the handle concentric with the barrel and having a drive shaft drivingly connected with the barrel for rotation thereof with built-in control for limiting the top speed of the electric motor. Electric power is supplied operatively connected with the motor through the handle for supplying power to the motor. Electric power supply is operatively connected with the electric heating element through the handle for supplying power to the heating element while permitting rotation of the barrel. There are controls for regulating operation of each of the electric power supplies. A hair clip extends along and parallel to a major portion of the heated curling barrel but stopping short of the annulus adjacent the tip end. This clip has the end removed from the tip end pivotally mounted on the barrel for movement toward and away from the barrel and has a handle for pivotally operating the clip relative to the barrel. An electrical power supply cord has a swivel connection at the other end of the handle with this swivel connection supplying electric current to each of the electric power supply means. The handle has an outer continuous shell extending from the power supply end thereof to the rotatable mounting of the curling barrel in one end of the handle.

In the drawings,

FIG. 1 is a side elevational view of the curling device of this invention, the same being mostly in section to illustrate the construction;

FIG. 2 is an electrical diagram showing the supply of electric power to the motor and to the heating element of FIG. 1;

FIG. 3 is a sectional view taken along the line 3—3 of FIG. 1;

FIG. 4 is a sectional view taken along the line 4—4 of FIG. 1; while

FIG. 5 is an enlarged sectional view taken along the line 5—5 of FIG. 1.

The embodiment of the hair curling device as shown in the drawings comprises a handle 10 which, in the present case, comprises an upper half **10*a* and a lower half 10*b* secured together by suitable bolts 11. The front end of the handle 10 forms a socket for rotatably receiving the enlarged cylindrical rear end of a curling barrel 12. The enlarged rear end of the barrel 12 is formed by a cylindrical member 50 attached to the end of the barrel 12. The member 50 is secured in a member 13. The barrel 12, member 50 and member 13 are rotatable as a unit and members 13 and 50 forming the enlarged rear end are rotatably received in the socket at the front of the handle. A stop flange 52 at the rear of the socket abuts the rear face of the enlarged rear end of the curling barrel. An annular cap-like coupling member 51 is secured to and surrounds the front end of the handle 10 for coupling the enlarged rear end of the curling barrel in the socket while allowing rotation of the curling barrel 12 relative to the handle 10. The flange 53 of caplike coupling member 51 abuts the front face of the enlarged end of the barrel to retain the enlarged end in the handle socket. The barrel 12 is a cylindrical hollow shell made of either chromium plated or stainless steel and has a separate tip end member 14*a* formed from a heat insulating plastic material attached to the other end thereof. A heating element 15 is mounted inside of the barrel 12 and will be later described. The motor has a drive shaft 16*a*, which is connected by coupling 18 to an electrically insulating plastic drive connection 19, which is firmly connected at 20 to an end wall portion of the member 13**.

Power is supplied to the heating element 15 and to the motor 16 through an electric power supply cord 21, which has a swivel connection at 22 with electrical conductors within the handle 10, which prevents tangling up of the supply cord. The swivel connection at 22 is best seen in FIG. 5 and comprises a plastic fitting 23 held in the end of the handle 10, and through which the lines **21*a* and 21*b* extend. Line 21*a* is connected outwardly to the slip ring 24 which is contacted by an electrically conducting shoe 25, which leads the current to a connection 26. Line 21*b* extends directly centrally through the fitting and a post 27, which is contacted at its outer end by a shoe 28, which leads to the connection 29 inside the handle. Thus, the handle 10 may rotate relative to the supply cord 21 and connections are assured through 25 and 28** at all times.

Inside the handle, an electric wire 30 leads from the connection 26 through a branch connection 31, a switch 32 and a connection 33 to motor 16. An electric wire 34 extends from the connection 29 and through a branch connection 35 to complete the supply to the motor 16.

The electric wire 30 further includes a line 36 and a shoe 37, which bears on a slip ring 38, and thus is carried to the connection 39, which is part of the heating element 15. The other electric cord 34 is connected by shoe 40 to slip ring 41 to connection 42, which is the other conductive side of the heating element 15. It will be noted in FIG. 1 that the slip rings 38 and 41 are electrically insulated from each other through the plastic insulating drive connection 19. This permits rotation of the curling barrel 12 and its heating element 15 by the motor 16 without disturbing the electric supply to the heating element 15.

The electric power supply is controlled first by a control switch 43 in the cord 21, which will turn the power on and off with respect to the heating element 15 and motor switch 32. With the switch 43 in the "on" position, then power is supplied to the motor 16 by the operator pressing down upon the button 44, which closes the switch 32, thus operating the motor 16 as long as the operator presses the button.

It should be understood that the representation of motor 16 includes any necessary rheostat control limiting the upper speed possible to obtain with the motor. Preferably, this speed would be in the neighborhood of 35 r.p.m.

A hair clip 45 extends along a major portion of the heated barrel 12 and is curved complementary to the barrel. This clip is pivotally mounted at 46 relative to the barrel, and is operated by a rearwardly extending handle 47. Preferably a small leaf spring 48 between the handle 47 and the barrel 12 urges the handle toward the closed, clipped position as seen in FIG. 1.

Finally, the handle comprises a continuous shell extending from the rear end of the device at 23 forwardly to the barrel connection. This shell comprises an upper half 10*a* and a lower half 10*b* fastened together as previously stated by bolts 11.

It will be noted that the member 14*a* has a heat insulating annulus 14 extending entirely around the barrel and protruding radially outwardly between about ⅛ inch to ¼ inch outside of barrel 12, so that it is the part of the curling iron which will first touch the scalp of a client and will not cause burning.

In operation, the device is plugged into an electrical outlet and then the cord switch 43 is turned on to send the electric current to the heating element 15 to heat up the barrel 12. Then the operator presses down on the handle 47, as seen in FIG. 1, to open up the clip 45, and he puts an end of the client's hair between the clip and the barrel 12. The operator may start the curling process manually, but later he will press the button 44 to start the slow turning movement of the barrel 12 with the hair clip holding the patient's hair in the operated position. Releasing of the button 44 stops the rotation.

What is claimed is:

1. A hair curling device comprising an elongated handle having a front end forming a socket, said handle including a pair of side-by-side sections coupled together by fasteners, a hollow enlongated cylindrical hair curling barrel having a cylindrical enlarged rear end rotatably received in the socket of said handle front end, an annular cap-like coupling member secured to and surrounding said handle front end and coupling said curling barrel enlarged end in said handle socket while allowing rotation of said curling barrel relative to said handle, said curling barrel extending forwardly from the front end of said handle, stop means located in the socket of said handle front end and abutting the rear face of said barrel enlarged end when such end is received in the socket of said handle front end, said cap-like coupling member abutting the front face of said barrel enlarged end to retain the enlarged end in said socket, an electric heating element mounted in the hollow of said barrel for rotation therewith, said barrel being electrically insulated from said heating element, a thermally insulating tip end member on the other end of said barrel, said tip end member being a smooth extension of said curling barrel and including a heat insulating radially extending annulus between said tip end member and the other end of said curling barrel, said tip end member and annulus being made of heat insulating material, said radially extending annulus being adapted to contact the scalp during use of the device to prevent burning of the scalp by the curling barrel, a fractional horsepower electric motor fixed in said handle concentric with said barrel, said electric motor having a drive shaft drivingly directly connected to an electrically insulative drive coupling, said drive coupling being mounted in said handle and connected to said curling barrel enlarged end for rotating said curling barrel, said motor including built-in means limiting the top speed of said electric motor, said handle having a swivel electric connector on a rear end thereof, a pair of heating element slip rings electrically connected to the terminals of said heating element and mounted on said drive coupling for rotation therewith, a pair of heating element electrical shoes fixedly mounted in said handle and slidingly electrically connected to respective ones of said heating element slip rings, a motor control switch on said handle, electrical connections connecting said handle swivel electric connector to said motor via said motor switch, electrical connections connecting said handle swivel electrical connector to said heating element shoes thereby providing an electrical circuit which permits rotation of said heating element and said curling barrel relative to said handle, an electric power supply cord connected to said handle swivel electric connector for supplying power to said motor and said heating element while permitting rotation of said power cord relative to said handle a hair clip extending along and parallel to a major portion of said curling barrel but stopping short of said radially extending annulus, the end of said clip removed from said tip end member being pivotally mounted on said barrel for movement toward and away from said barrel and being provided with an operating handle for pivotally oscillating said clip relative to said barrel, said handle swivel electric connector having a pair of handle slip rings and a pair of handle shoes electrically and slidingly connected thereto, said electric cord being connected to said slip rings and said electrical connections being connected to said handle shoes so that said handle can rotate relative to said power supply cord without tangling said power supply cord, whereby said swivel connection supplies electric current to said electric motor and electric heating element, said handle sections forming an outer continuous shell extending from said handle rear end to said handle front end, and a control switch in said electric power supply cord for controlling the supply of power to said heating element and said motor switch.

* * * * *